United States Patent [19]

Matsuo

[11] Patent Number: 5,076,561

[45] Date of Patent: Dec. 31, 1991

[54] ELECTRONIC PHOTO-COPYING APPARATUS

[75] Inventor: Toshihisa Matsuo, Yamatokoriyama, Japan

[73] Assignee: Sharp Kabushiki Kaisha, Osaka, Japan

[21] Appl. No.: 506,299

[22] Filed: Apr. 10, 1990

[30] Foreign Application Priority Data

Apr. 13, 1989 [JP] Japan ..... 1-95651

[51] Int. Cl.[5] ..... B65H 3/44

[52] U.S. Cl. ..... 271/9; 271/241; 271/162

[58] Field of Search ..... 271/145, 162, 164, 171, 271/241, 9; 355/311

[56] References Cited

U.S. PATENT DOCUMENTS

| | | | |
|---|---|---|---|
| 4,294,535 | 10/1981 | Ariyama et al. | 271/171 |
| 4,763,889 | 8/1988 | Dei et al. | 271/9 |
| 4,788,571 | 11/1988 | Ura et al. | 271/171 |
| 4,861,017 | 8/1989 | Yamamoto et al. | 271/145 |

FOREIGN PATENT DOCUMENTS

| | | | |
|---|---|---|---|
| 56-121059 | 9/1981 | Japan . | |
| 123859 | 7/1984 | Japan . | |
| 262735 | 12/1985 | Japan | 271/241 |
| 27253 | 2/1987 | Japan | 271/171 |
| 185757 | 8/1988 | Japan | 271/171 |

*Primary Examiner*—H. Grant Skaggs

[57] ABSTRACT

An electronic photo-copying apparatus in accordance with the present invention comprises: at least one paper feed device comprising a paper feed cassette rotatably supported so as to move in the feeding direction thereof interchangeably between the longitudinal and lateral directions and a driving device for rotating the paper feed unit; and, a control device for controlling the paper feed device so as to permit it to switch the feeding direction of copy paper interchangeably between the longitudinal and lateral feeding directions by rotating the paper feed device by the driving device regardless of operation conditions of an electronic photo-copying apparatus main body. With the above arrangement, since the paper feed cassette can be rotated in the direction interchangeably between the longitudinal and lateral directions even when the electronic photo-copying apparatus main body is in operation, waiting time can be eliminated which is required for switching the feeding directions of copy paper stored in the paper feed cassette, and therefore working efficiency can be improved.

22 Claims, 7 Drawing Sheets

ELECTRONIC PHOTO-COPYING APPARATUS

FIELD OF THE INVENTION

The present invention relates to electronic photo-copying apparatus such as copying machines or laser printers, and more specifically to electronic photo-copying apparatus having a paper feed device capable of rotating so as to feed copy paper in either longitudinal or lateral feeding direction selectively.

BACKGROUND OF THE INVENTION

Generally, a copying machine referred to as electronic photo-copying apparatus is able to copy a document on copy paper having one of various sizes such as A3, A4, B4, or B5. The copying machine is also able to copy on copy paper of each size above-mentioned in either longitudinal or lateral direction. Accordingly, for example, in the case of using cassettes for storing sheets of copy paper, the copying machine has to be prepared with some paper feed cassettes classified by each size of copy paper and/or by each feeding direction thereof.

However, in the copying machine above-mentioned, every time the size or feeding direction of the copy paper is changed, replacement work for the paper feed cassettes is necessary. Even in the case where some of paper feed cassettes are housed beforehand in the copying machine so as to solve the above problem, a problem is still presented in that the copying machine tends to become bulky.

Therefore, a copying machine designed to solve the above problems has been disclosed in Japanese Publication for Unexamined Patent Application No. 121059/1981, wherein the machine comprises a direction switching device for performing a 90-degree turn in the feeding direction of copy paper by attracting it on its conveying way according to the necessity so as to optionally feed copy paper in either longitudinal or lateral direction depending on each size of each feeding direction thereof.

However, in the copying machine having the above direction switching device, there are still presented problems in that the direction switching device itself tends to become bulky and it tends to be difficult to determine the conveying direction of copy paper accurately after the direction switching process.

Recently, there has been designed a copying machine which has one or more rotatable paper feed cassettes capable of interchangeably executing a 90-degree turn in the feeding direction of copy paper thereof between the longitudinal and lateral feeding directions. In the copying machine as described above, however, when the copying machine body is in operation, the rotatable paper feed cassettes are brought into unoperable condition.

The reason is that, since power supply for the driving motor for rotating copy paper in the paper feed cassette is usually performed from the power source device of the copying machine main body, when it is designed to operate the copying machine main body and the driving motor for the rotatable paper feed cassettes at the same time, it is necessary to make the capacity of its power source substantially great, and therefore this causes the whole apparatus to be more expensive.

Nevertheless, it will bring a better operation efficiency to permit the apparatus to have the simultaneous operations between the copying machine main body and the driving motor for the rotatable paper feed cassettes. This is because waiting time can be eliminated which is required for switching the feeding directions of copy paper. By achieving the above arrangement, the copying machine can eliminate loss of personnel expenses due to the waiting time, and this advantage will more than cover an increase in cost due to having a more expensive power source device. In addition, the above problems are common in any electronic photo-copying apparatus whether or not it is a copying machine having one or more rotatable paper feed cassettes.

SUMMARY OF THE INVENTION

It is an object of the present invention to provide an electronic photo-copying apparatus, wherein waiting time can be eliminated by permitting its driving motor for paper feed cassettes to be operable even when the main body of the electronic photo-copying apparatus is in operation.

In order to achieve the above object, the electronic photo-copying apparatus of the present invention comprises control means which is capable of switching the paper feeding direction between the longitudinal and lateral directions by rotating a paper feed cassette by a driving unit regardless of operation conditions in the electronic photo-copying apparatus main body.

Having the above arrangement, the control means is able to rotate the paper feed unit to either a longitudinal or lateral feeding direction by actuating the driving unit regardless of operational conditions in the main body of the electronic photo-copying apparatus. Accordingly, the electronic photo-copying apparatus is permitted to switch the feeding direction of copy paper stored in the paper feed unit even when its main body is in operation.

For a fuller understanding of the nature and advantages of the invention, reference should be made to the ensuing detailed description taken in conjunction with the accompanying drawings.

BRIEF DESCRIPTION OF THE DRAWINGS

FIG. 1 is a vertical sectional view of a copying machine.

FIG. 2 is a perspective view showing the main part of the copying machine.

FIG. 3(*a*) is a perspective view showing a rotatable cassette unit.

FIG. 3(*b*) is an enlarged perspective view showing a state wherein a threaded shaft is engaged into a nut member.

FIG. 4 is an explanatory diagram showing the rotating process of a rotatable cassette.

FIG. 5 is an explanatory diagram showing a control system.

FIG. 6(*a*) is a schematic front view of an operation unit.

FIG. 6(*b*) is an enlarged front view showing a part of a copying mode display unit disposed in the operation unit.

FIG. 7 is a flow chart showing the control operation of the copying machine.

DESCRIPTION OF THE EMBODIMENTS

The following description will discuss one embodiment of the present invention with reference to FIGS. 1 to 7.

Figure 1:
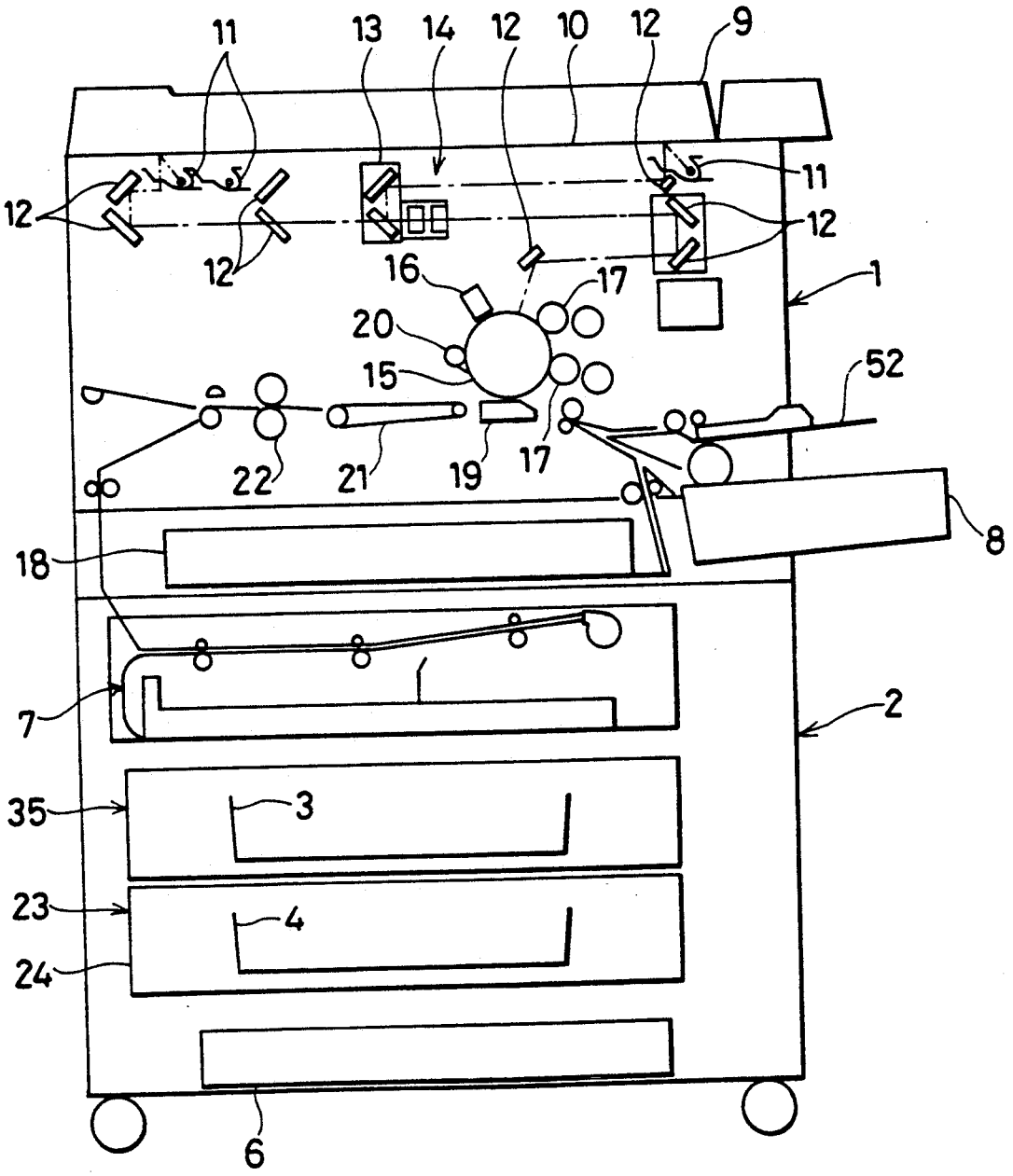
FIGS. 1 to 7 show one embodiment of the present invention.

As shown in FIG. 1, a copying machine referred to as an electronic photo-copying apparatus comprises a copying machine main body 1, or an electronic photo-copying apparatus main body, and a desk part 2 comprising paper feed cassettes 3, 4 forming paper feed units for feeding copy paper to the copying machine main body 1 and an automatic side reversing device 7 capable of reversing the sides of copy paper.

On a document glass plate 10 inside the copying machine main body 1, there is installed an automatic document feeder 9 for automatically feeding a document. On the other hand, under the document glass plate 10, there are installed a plurality of light sources 11. Below the light sources 11, there is disposed an optical system 14 comprising a plurality of mirrors 12 and lenses 13. Below the optical system 14, there is rotatably installed a photosensitive drum 15. The photosensitive drum 15 is adapted to be exposed an optical image of a document (not shown) on the surface thereof which is brought through the optical system 14.

Around the photosensitive drum 15, there are disposed a charger 16 for having the surface of the photosensitive drum 15 charged with electric charges, a plurality of developing devices 17 for developing an electrostatic latent image by using toner to form a toner image on the surface of the photosensitive drum 15, a transferring charger 19 for transferring the toner image onto copy paper, a cleaning roller unit 20 for cleaning off the remaining toner on the surface of the photo receptor drum 15 after transferring the toner image, or other devices.

At the rear side of the photosensitive drum 15, are installed a conveyer unit 21 for conveying the copy paper after transferred the toner image thereon and a fixing roller 22 for fixing the toner image on the copy paper conveyed by the conveyor unit 21. The copy paper, after having passed through the fixing roller 22, is then discharged onto a copy receiving tray(not shown).

Sheets of copy paper which are fed to the photosensitive drum 15 are supplied from paper feed cassettes 18, 8, which are disposed in the lower part of the copying machine main body 1, a manual paper feed tray 52, and paper feed cassettes 3, 4, 6 which are housed in the desk part 2. In addition, each of the paper feed cassettes 18, 6 can store 250 sheets of copy paper, while the paper feed cassette 8 located under the manual paper feed tray 52 can store 500 sheets of copy paper. Moreover, the paper feed cassette 3 is disposed inside a rotatable paper feed cassette unit 35, while the paper feed cassette 4 is disposed inside a rotatable paper feed cassette unit 23. The rotatable paper feed cassette units 35, 23 respectively function as paper feed means for permitting a 90-degree turn in the paper feeding direction thereof.

Figure 2:
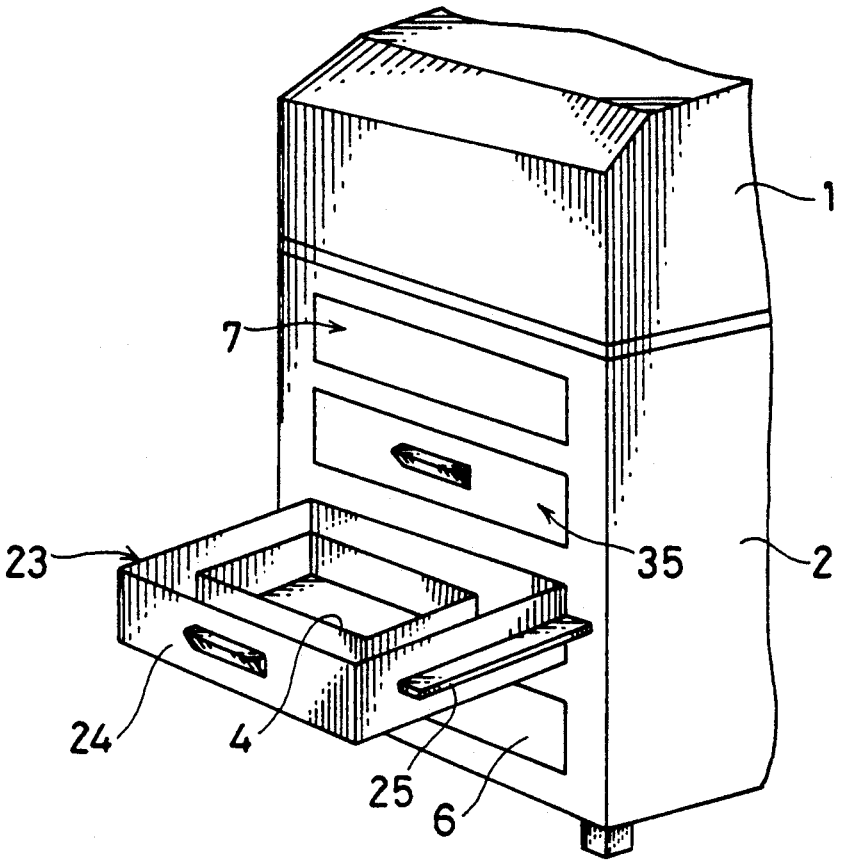

The rotatable paper feed cassette unit 23, as shown in FIG. 2, comprises a cassette case 24 which is provided with rails 25 on both sides thereof and is removably supported to the desk part 2 by the rails 25 thereof. Inside the cassette case 24, is installed the paper feed cassette 4 rotatably supported to the cassette case 24 so as to substantially execute a 90-degree turn in feeding direction of copy paper thereof between the longitudinal and lateral feeding directions.

Figure 3:
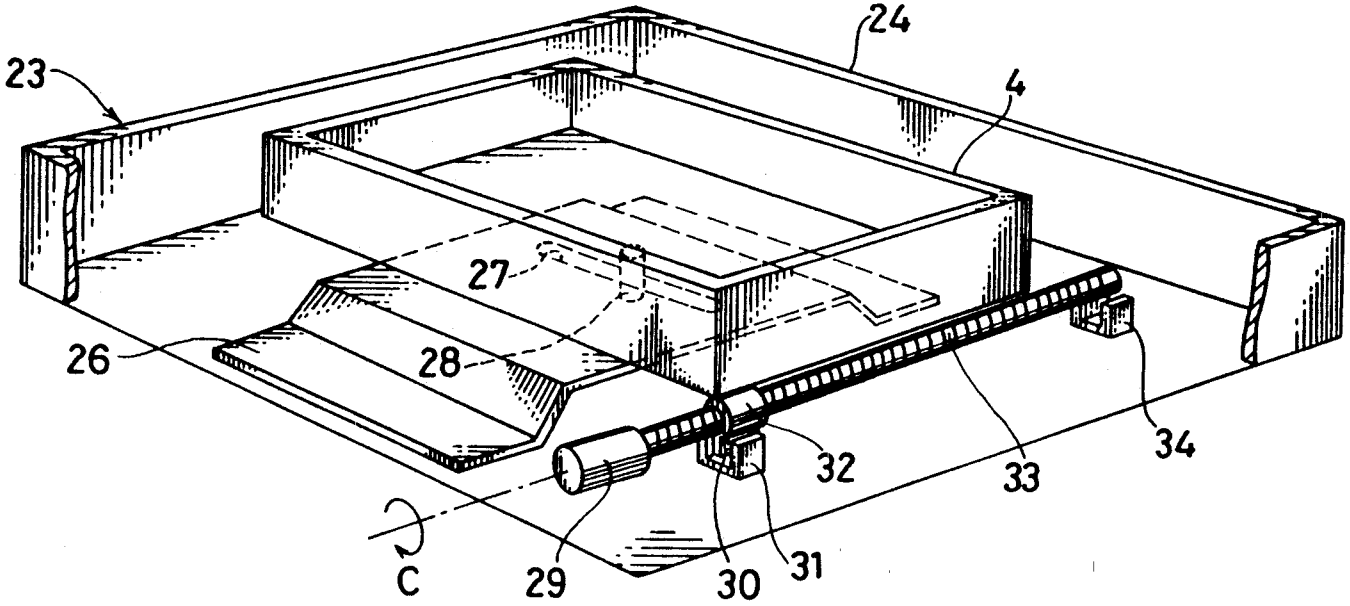
Figure 3:
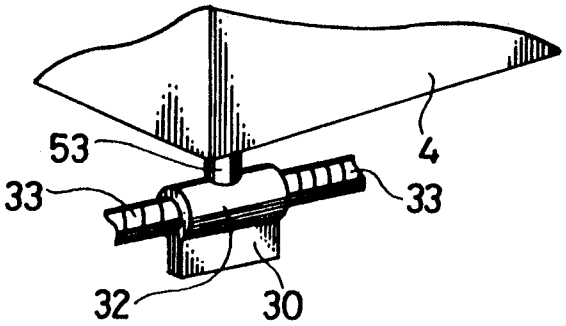

As shown in FIG. 3(*a*), on the bottom of the cassette case 24 there is disposed a bending support plate 26 for keeping a predetermined distance between the bottom of the cassette case 24 and that of the paper feed cassette 4. In the support plate 26, is formed a guiding hole 27 extending in the width direction of the cassette case 24. On the other hand, on the under surface of the bottom of the paper feed cassette 4, is formed a guiding shaft 28 protruding downward at the center of gravity thereof, and the guiding shaft 28 is moveable along the guiding hole 27 of the support plate 26 as well as rotatable therein, thereby permitting the paper feed cassette 4 to be rotatably moveable.

Furthermore, by the side of the paper feed cassette 4, there is installed a threaded shaft 33 in a right-angled direction to the guiding hole 27. The threaded shaft 33 is rotatably supported by a bearing (not shown) so as to rotate clockwise (in the direction indicated by C in FIG. 3(*a*)) or counterclockwise by a driving motor 29 functioning as a driving unit. The threaded shaft 33 is also engaged with a nut member 32, and the nut member 32 is permitted to make reciprocating motion along the threaded shaft 33 according to the rotation of the threaded shaft 33. For example, in the case where a right-hand thread is used, when the threaded shaft 33 is rotated clockwise, the nut member 32 is permitted to move toward a first photointerrupter 31, and when the threaded shaft 33 is rotated counterclockwise, the nut member 32 is permitted to move toward a second photointerrupter 34. The nut member 32 is rotatably connected to a joint 53 secured at one corner of the under surface of the bottom of the cassette case 4, as shown in FIG. 3(*b*). There is formed a light interrupting part 30 at the lower part of the nut member 32.

On the other hand, on the cassette case 24, there are installed a first photointerrupter 31 and a second photointerrupter 34 as detecting devices, and the former detects that the paper feed cassette 4 is in the longitudinal feeding direction, and the latter, in the lateral direction. In addition, the above detecting devices are not limited to photointerrupters, but may be, for example, magnetic sensors, limit switches, or other similar devices.

The first and second photointerrupters 31, 34 respectively comprise a light emitting element and a light receiving element. When the light interrupting part 30 at the lower part of the nut member 32 passes by the first photointerrupter 31 between the light emitting element and the light receiving element thereof, an output of the first photointerrupter 31 is turned on, while the light interrupting part 30 passes by the second photointerrupter 34 between the light emitting element and the light receiving element thereof, an output of the second photointerrupter is turned on. By interrupting light emitted from the light emitting element and coming to the light receiving element, this arrangement permits detection of the completion of a rotative operation between the longitudinal and lateral feeding directions with respect to the paper feed cassette 4.

Figure 4:
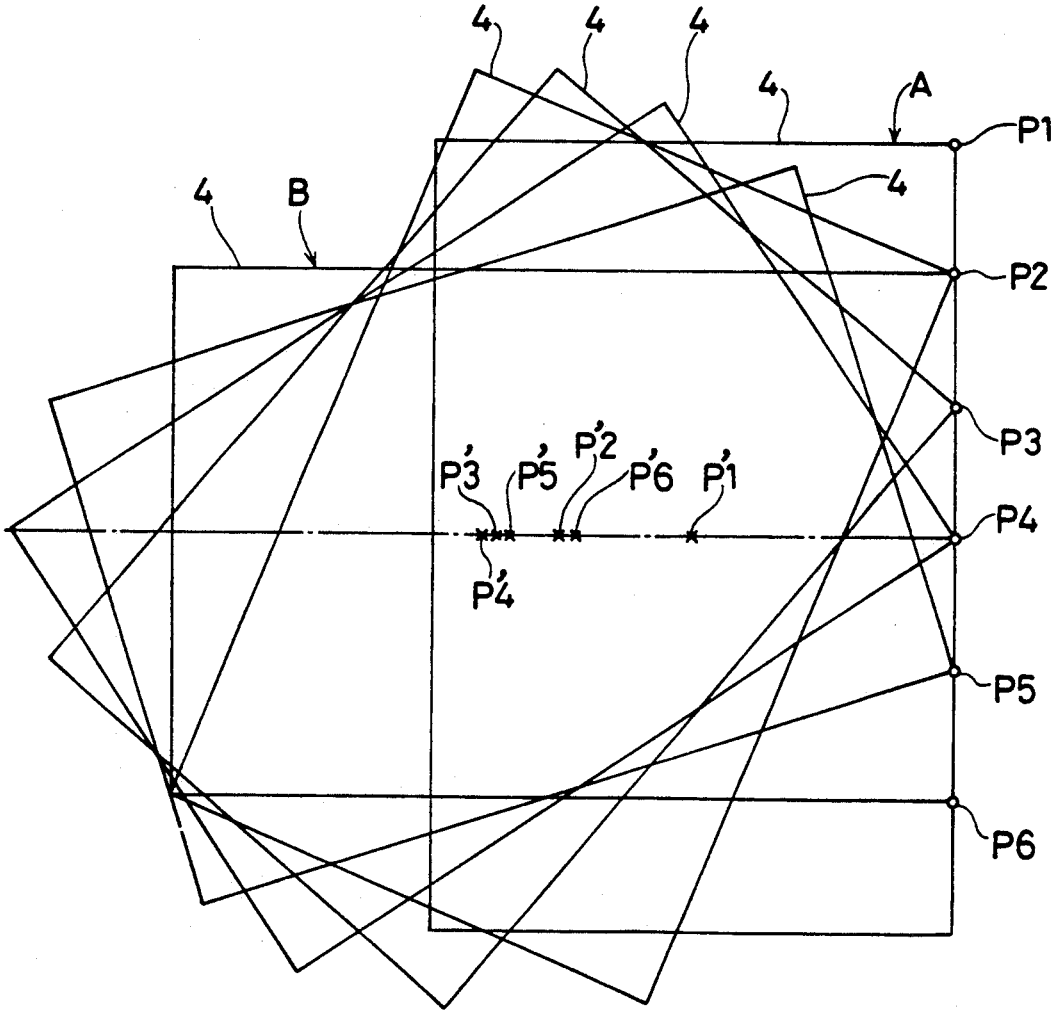

Accordingly, while the driving motor 29 rotates the threaded shaft 33 clockwise (in the direction indicated by C) and the nut member 32 moves along the threaded shaft 33 following a sequence P1, P2, P3, P4, P5 and P6 as shown in FIG. 4, the guiding shaft 28, rotating in the guiding hole 27, reciprocally moves following a sequence P1', P2', P3', P4', P5' and P6'. As the sequences proceed, the paper feed cassette 4 is permitted to execute a 90-degree turn to change the paper feeding direction thereof from the direction A to the direction B in FIG. 4. On the other hand, when the driving motor 29 is rotated counterclockwise, reversed sequences to the above proceed, and the paper feed cassette makes a 90-degree turn to change the paper feeding direction thereof from the direction B to the direction A.

Moreover, the rotatable paper feed cassette unit 35 disposed above the rotable paper feed cassette unit 23 has the same construction as the rotatable paper feed cassette unit 23 as shown in FIG. 1, and therefore it permits the paper feed cassette 3 to execute a 90-degree turn in feeding direction of copy paper thereof between the longitudinal and lateral feeding directions.

Figure 5:
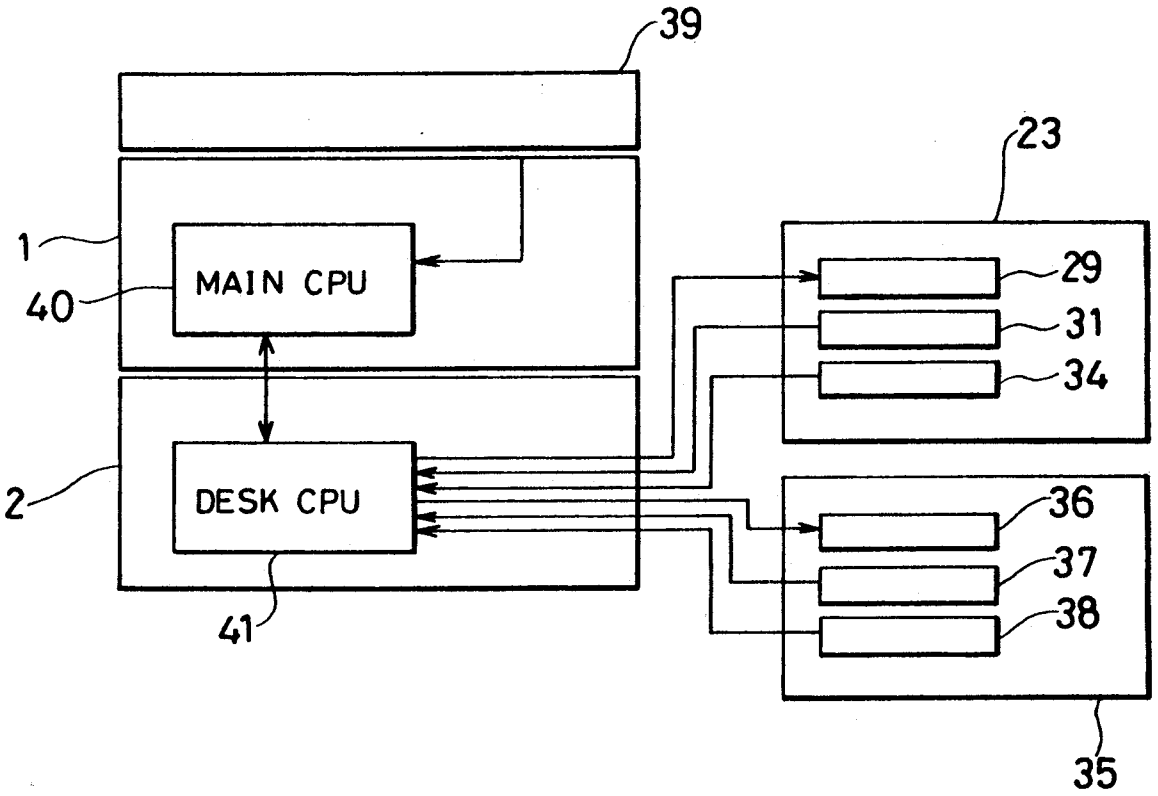

In the copying machine main body 1, there is installed a main CPU 40 (Central Processing Unit) as shown in FIG. 5. To the main CPU 40, are connected an operation panel 39, and a desk CPU 41 installed in the desk part 2 and functioning as control means.

To the desk CPU 41, are connected the driving motor 29 secured in one of the rotatable paper feed cassette units 23, the first photointerrupter 31 and the second photointerrupter 34. Furthermore, to the desk CPU 41, are connected a driving motor 36 secured in the other rotatable paper feed cassette unit 35, a first photointerrupter 37 and a second photointerrupter 38. With the above construction, the rotatable paper feed cassette units 23, 35 are designed to be respectively operable by the operation panel 39 through the main CPU 40 and the desk CPU 41.

Figure 6:
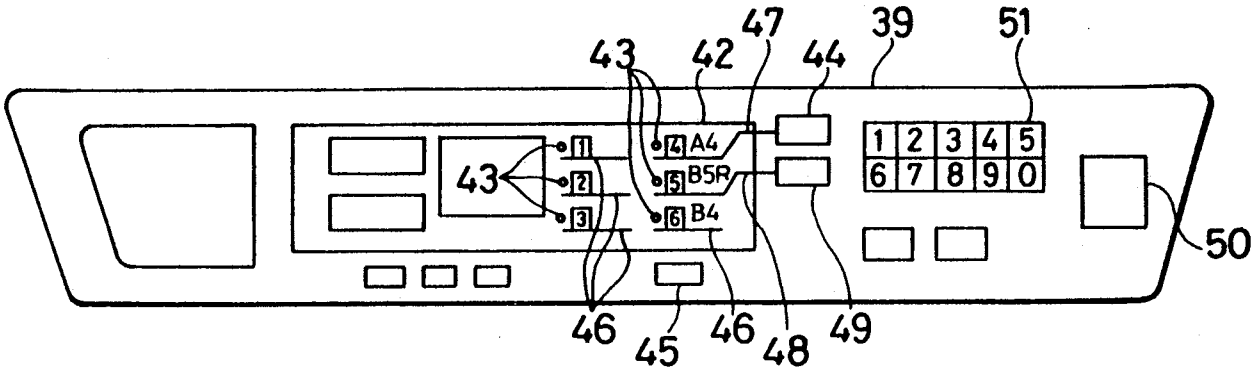
Figure 6:
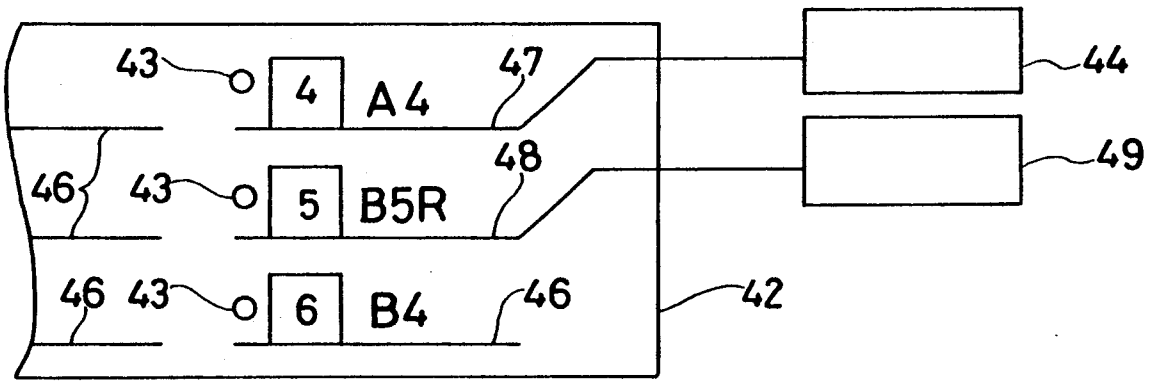

On the operation panel 39, as shown in FIG. 6(*a*), there are disposed a copy button 50 for instructing a start of a copying operation, ten keys 51 for setting the number of copies and other factors, and copy mode display 42 for selecting various copy modes and displaying the modes. The copy mode display 42 is provided thereon with cassette mode displays 46, 47, 48. As shown in FIG. 6(*b*), the cassette mode displays 46, 47, 48 includes numbers 1 to 6 given thereon so as to respectively specify a manual paper feed tray 52, and each of paper feed cassettes 8, 18, 4, 3, 6, and also includes such marks as A4 or B5R thereon so as to display the size and feeding direction of copy paper.

As to paper feed cassettes which are not set among the manual paper feed tray 52 and the paper feed cassettes 8, 18, 4, 3, 6, the size and feeding direction of copy paper of those paper feed cassettes are not displayed on the respective displaying positions indicated by the numbers 1 to 6 respectively corresponding to each of the tray and the cassettes in the cassette mode displays 46, 47, 48. Moreover, on the cassette mode displays 46, 47, 48 are disposed indicators 43, one of which is turned on showing a selected paper feed tray or cassette among the manual paper feed tray 52 and paper feed cassettes 8, 18, 4, 3, 6. The manual paper feed tray 52 or each of the paper feed cassettes 8, 18, 4, 3, 6 is optionally selectable by a cassette changeover switch 45.

On the other hand, the cassette mode displays 47, 48 have respective cassette rotation switches 44, 49 disposed at the vicinities thereof. In the above arrangement, for example, in the case where the cassette mode display 47 shows A4, when the cassette rotation switch 44 thereof is depressed, the specified paper feed cassette 4 is rotated, thereby changing the display from A4 to A4R. When the cassette rotation switch 44 is successively depressed again, the paper feed cassette 4 is rotated again, and the display changes from A4R to A4.

Figure 7:
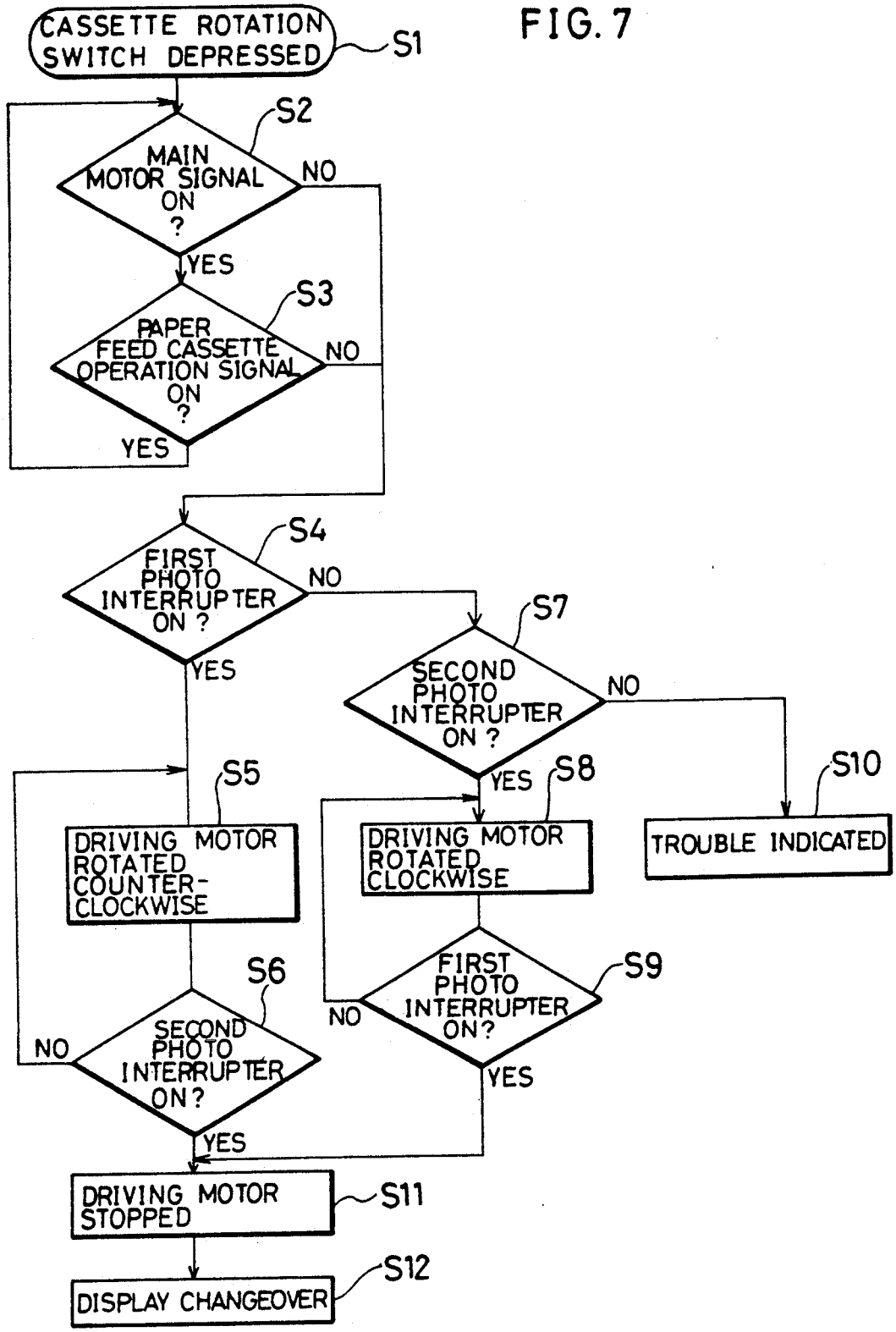

Referring to a flow chart in FIG. 7, the following description deals with control operations on the driving motors 29 by the main CPU 40 and the desk CPU 41 in accordance with the above arrangement. In the following sequence, additional reference numerals denoted using square brackets [ ] show a sequence of control operations when the driving motor 36 is actuated.

At first, when the cassette rotation switch 44[49] is depressed (S1), the main CPU 40 judges whether a signal from a main motor (not shown) installed in the copying machine main body 1 is "on" or not. If the signal from the main motor is "on", the copying machine main body 1 is in operation, and if it is not "on", the copying machine main body 1 is in a stand-by state (S2).

When the signal from the main motor is "on", that is to say, the copying machine main body 1 is in operation, the main CPU 40 sends a signal to the desk CPU 41, which specifies the depressed cassette rotation switch 44[49]. At this time, the desk CPU 41 has recognized whether the rotatable paper feed cassette unit 23[35] is in operation or not. Accordingly, in the case where the rotatable paper feed cassette unit 23[35] specified by the signal is in operation, the desk CPU 41 sends, for example, a high-level signal according to binary logic as a signal showing "in operation" to the main CPU 40. On the other hand, in the case where the rotatable paper feed cassette unit 23[35] specified by the signal is in a stand-by state, the desk CPU 41 sends, for example, a low-level signal according to binary logic as a signal showing "in a stand-by state" to the main CPU 40. The main CPU 40 thus receives the signal, judges whether it is a high-level signal or not, and permits the sequence to return to S2 if it is a high-level signal (S3).

When the signal from the main motor is not "on", or the rotatable paper feed cassette unit 23[35] specified by the depressed cassette rotation switch 44[49] is in a stand-by state at S2, the desk CPU 41 judges whether a signal from the first photointerrupter 31[37] is "on" or not. The first photointerrupter 31[37] is located in the rotatable paper feed cassette unit 23[35] specified by the depressed cassette rotation switch 44[49] (S4).

When the signal from the first photointerrupter 31[37] is "on", the driving motor 29[36] for rotating the paper feed cassette 4[3] is actuated to rotate counterclockwise (the opposite direction to that shown by C in FIG. 3(*a*))(S5).

The counterclockwise rotations of the driving motor 29[36] continue until the light interrupting part 30 of the nut member 32 is permitted to move to the position where the second photointerrupter 34[38] is located (at this time, an output signal from the second photointerrupter 34[38] is turned on). The sequence, therefore, returns to S5 unless the signal from the second photointerrupter 34[38] is "on" (S6).

On the other hand, at S4, when the signal from the first photointerrupter 31[37] is not "on", the desk CPU 41 judges whether a signal from the second photointerrupter 34[38] is "on" or not (S7).

In the case where the signal from the second photointerrupter 34[38] is not "on", the desk CPU 41 releases a signal to the main CPU 40 which shows that the specified paper feed cassette 4[3] is neither set in the longitudinal direction nor in the lateral direction due to a certain malfunction. Having received the signal, the main CPU 40 then instructs to display a trouble message (S10).

Moreover, at S7 in the above, when the second photointerrupter 34[38] is on, the driving motor 29[36] for rotating the paper feed cassette 4[3] is actuated to rotate clockwise (in the direction indicated by C in FIG. 3(*a*)) (S8).

The clockwise rotations of the driving motor 29[36] continue until the light interrupting part 30 of the nut member 32 located in the rotatable paper feed cassette unit 23[35] is permitted to move to the position where the first photointerrupter 31[37] is located. The sequence, therefore, returns to S8 unless the signal from the first photointerrupter 31[37] is "on" (S9).

Next, when the second photointerrupter 34[38] is "on" at S6 or when the first photointerrupter 31[37] is "on" at S9, the desk CPU 41 stops the driving motor 29[36] (S11).

Then, the desk CPU 41 sends a signal so as to change a display showing the feeding direction of copy paper which has been displayed on the cassette mode display 47 [48] (S12).

According to the above sequence, in the copying machine, by depressing the cassette rotation switch 44[49] in the operation panel 39 disposed on the copying machine main body 1, it is possible to switch the feeding direction of copy paper stored in the paper feed cassette 4[3] on condition that the rotatable paper feed cassette unit 23[35] is in a stand-by state, regardless of operation conditions of the copying machine main body 1.

As described above, an electronic photo-copying apparatus of the present invention comprises control means connected to paper feed means which is capable of switching the feeding direction of copy paper interchangeably between the longitudinal and lateral feeding directions by rotating a paper feed unit by a driving unit regardless of operation conditions of the electronic photo-copying apparatus main body.

With the above arrangement, since the control means connected to the paper feed means is able to rotate the paper feed unit interchangeably between the longitudinal and lateral feeding directions by the driving unit regardless of operation conditions of the electronic photo-copying apparatus, waiting time can be eliminated which is required for switching the feeding directions of copy paper stored in the paper feed unit.

The invention being thus described, it may be obvious that the same may be varies in many ways. Such variations are not to be regarded as a departure from the scope of the invention.

There are described above novel features which the skilled man will appreciate give rise to advantages. These are each independent aspects of the invention to be covered by the present application, irrespective of whether or not they are included within the scope of the following claims.

What is claimed is:

1. An electronic photo-copying apparatus comprising:

an electronic photo-copying apparatus main body;

a plurality of paper feed means including at least one rotatable paper feed means comprising a cassette rotatably supported so as to move in the feeding direction thereof interchangeably between the longitudinal and lateral directions and a driving unit for rotating the cassette; and, control means for controlling the driving unit so as to permit it to rotate the cassette, wherein in response to an instruction to switch the feeding direction of the rotatable paper feed means which is given when the paper feed means other than the rotatable paper feed means is feeding copy paper independently of any operation conditions of the rotatable paper feed means, the control means controls the driving units so as to permit it to rotate the rotatable paper feed means.

2. An electronic photo-copying apparatus as defined in claim 1, wherein said cassette is removably supported in the electronic photo-copying apparatus main body.

3. An electronic photo-copying apparatus as defined in claim 2, wherein said cassette is a paper feed cassette.

4. An electronic photo-copying apparatus as defined in claim 3 further comprising a supporting plate mounted on a bottom of a paper feed unit and having a guiding hole formed therein and having a shape which positions the bottom of the paper feed cassette not to directly contact said bottom of said paper feed unit.

5. An electronic photo-copying apparatus as defined in claim 4, wherein the paper feed cassette comprises a guiding shaft protruding downwardly at the bottom thereof which is movable along the guiding hole in reciprocating motions and is also rotatable within the guiding hole, thereby permitting the paper feed cassette to make a 90-degree turn.

6. An electronic photo-copying apparatus as defined in claim 3, wherein the driving unit comprises a motor capable of both clockwise and counterclockwise rotations.

7. An electronic photo-copying apparatus comprising:

an electronic photo-copying apparatus main body;

at least one paper feed means comprising a paper feed cassette case rotatably supported so as to move in the feeding direction thereof interchangeably between the longitudinal and lateral directions and a driving unit for rotating the paper feed cassette case;

control means for controlling the paper feed means so as to permit it to switch the feeding direction of copy paper interchangeably between the longitudinal and lateral feeding directions by rotating the paper feed cassette case by the driving unit independently of any operation conditions of the electronic photo-copying apparatus;

said cassette case is removably supported in the electronic photo-copying apparatus main body;

said driving unit comprises a motor capable of both clockwise and counterclockwise rotations;

said driving unit further comprises a threaded shaft and a nut member engaged therewith so as to make reciprocating movements along the threaded shaft as the threaded shaft rotates.

8. An electronic photo-copying apparatus as defined in claim 7, wherein the nut member comprises a light interrupting part for interrupting light.

9. An electronic photo-copying apparatus as defined in claim 7, wherein the nut member is rotatably connected to one corner of the under surface of the paper feed cassette bottom by a joint.

10. An electronic photo-copying apparatus as defined in claim 8, wherein the cassette case comprises a direction detecting means for detecting a direction in which the paper feed cassette is set which is adapted to detect whether the paper feed cassette is set in the longitudinal direction or in the lateral direction.

11. An electronic photo-copying apparatus as defined in claim 10, wherein the direction detecting means comprises two photointerrupters.

12. An electronic photo-copying apparatus as defined in claim 10, wherein the direction detecting means comprises two magnetic sensors.

13. An electronic photo-copying apparatus as defined in claim 10, wherein the direction detecting means comprises two limit switches.

14. An electronic photo-copying apparatus as defined in claim 1 further comprising main control means and an operation unit, wherein the paper feed means is operable at the operation unit through the main control means and the control means.

15. An electronic photo-copying apparatus as defined in claim 14, wherein the operation unit comprises at least one switch for starting to rotate the specified paper feed cassette in depressing the switch.

16. An electronic photo-copying apparatus comprising:

an electronic photo-copying apparatus main body;

a plurality of paper feed means including at least one rotatable paper feed means comprising a paper feed cassette rotatably supported so as to move in the feeding direction thereof interchangeably between the longitudinal and lateral directions and a driving unit for rotating the paper feed cassette;

control means for controlling the driving unit so as to permit it to rotate the paper feed cassette;

operation condition detecting means for detecting operation conditions of the paper feed means; and direction detecting means for detecting a direction in which the paper feed unit feeds copy paper, wherein in response to an instruction to switch the feeding direction of the rotatable paper feed means which is given when the paper feed means other than the rotatable paper feed means is feeding copy paper independently of any operation conditions of the rotatable paper feed means, the control means controls the driving unit individually based on the detections by the operation condition detecting means and the direction detecting means so as to permit it to rotate the rotatable paper feed unit independently of any operation conditions of the electronic photo-copying apparatus.

17. An electronic photo-copying apparatus as defined in claim 16, wherein the direction detecting means comprises a first photointerrupter which detects that the paper feed cassette is set in the longitudinal feeding direction and a second photointerrupter which detects that the paper feed cassette is set in the lateral feeding direction.

18. An electronic photo-copying apparatus as defined in claim 1 or 16 is a copying machine.

19. A method for rotating a paper feed cassette to switch the feeding direction of copy paper between the longitudinal and lateral directions independently of any operation conditions of an electronic photo-copying apparatus main body in an electronic photo-copying apparatus comprising the steps of:

detecting an operation condition of the paper feed cassette and keeping a sequence for rotating the paper feed cassette in a stand-by state until the operation of the paper feed cassette is stopped when the paper feed cassette is in operation, detecting whether the paper feed cassette is set in the longitudinal direction or in the lateral direction when the paper feed cassette has been stopped; and, switching the paper feed cassette in its feeding direction of copy paper between the longitudinal and lateral directions by rotating it by a driving unit depending on the direction detected in which the paper feed cassette is set.

20. A method as defined in claim 19, wherein two photointerrupters are adapted to detect whether the paper feed unit is set in the longitudinal direction or in the lateral direction.

21. A method as defined in claim 19 comprising the additional step of displaying a trouble message when the paper feed unit is neither set in the longitudinal direction nor in the lateral direction.

22. A method as defined in claim 20 comprising the additional step of displaying the direction in which the paper feed unit has been set when the paper feed unit has been rotated by the driving unit to switch the feeding direction of copy paper thereof between the longitudinal and lateral directions.

* * * * *